US008208831B2

(12) United States Patent
Kim

(10) Patent No.: US 8,208,831 B2
(45) Date of Patent: Jun. 26, 2012

(54) IMAGE FORMING CARTRIDGE MOUNTING STRUCTURE FOR IMAGE FORMING APPARATUS

(75) Inventor: Hyun-woo Kim, Busan (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 396 days.

(21) Appl. No.: 12/542,875

(22) Filed: Aug. 18, 2009

(65) Prior Publication Data

US 2010/0046983 A1 Feb. 25, 2010

(30) Foreign Application Priority Data

Aug. 19, 2008 (KR) ..... 10-2008-0081043
Aug. 11, 2009 (KR) ..... 10-2009-0073732

(51) Int. Cl.
*G03G 21/16* (2006.01)

(52) U.S. Cl. ..... 399/111; 399/119

(58) Field of Classification Search ..... 399/111, 399/119

See application file for complete search history.

(56) References Cited

U.S. PATENT DOCUMENTS 6,081,676 A * 6/2000 Inomata ..... 399/111
2006/0147225 A1 * 7/2006 Harada et al. ..... 399/111
2008/0170875 A1 * 7/2008 Kim et al. ..... 399/111

FOREIGN PATENT DOCUMENTS

JP 2007-219103 8/2007

* cited by examiner

*Primary Examiner* — Ryan Walsh
(74) *Attorney, Agent, or Firm* — Stanzione & Kim, LLP

(57) ABSTRACT

An image forming apparatus that includes a main body housing formed with an opening, a main body frame coupled to the main body housing, an image forming cartridge mounted to the main body frame via the opening, and a cartridge supporting member which includes a supporting member main body formed integrally with the main body frame, and a supporting part formed in the supporting main body to elastically support the image forming cartridge with respect to the main body frame, so that the image forming cartridge can be mounted to the main body frame as the supporting member main body elastically moves to a cutting part formed in a part of the main body frame adjacent to the supporting member main body when the supporting part is pressed by the image forming cartridge.

22 Claims, 5 Drawing Sheets

IMAGE FORMING CARTRIDGE MOUNTING STRUCTURE FOR IMAGE FORMING APPARATUS

CROSS-REFERENCE TO RELATED APPLICATIONS

This application claims priorities under 35 U.S.C. §119(a) of Korean Patent Application Nos. 10-2008-0081043 and 10-2009-0073732, filed on Aug. 19, 2008 and Aug. 11, 2009, respectively, in the Korean Intellectual Property Office, the disclosures of which are incorporated herein by reference.

BACKGROUND

1. Field of the Invention

The present inventive concept relates to an image forming apparatus forming an image on a printing medium, and more particularly, to an image forming apparatus having an improved mounting and supporting structure of an image forming cartridge.

2. Description of the Related Art

An image forming apparatus performs a printing operation of forming a visible image on a printing medium such as paper, etc. An image forming apparatus of an electrophotographic type includes an image forming unit which converts image data received from a host into an electrostatic latent image, and forms a visible image based on the electrostatic latent image by a developer on a printing medium, thereby performing the printing operation.

However, as the printing operation is repeated in the image forming unit of the image forming apparatus, the stored developer is exhausted, or an image carrying body for forming an image is worn away. Accordingly, to make replenishment for a consumed developer and replacement of internal elements easy, the image forming unit has been manufactured in the form of a detachable cartridge type.

A conventional image forming apparatus has a configuration of supporting a mounted cartridge not to move during a printing operation, thereby preventing an image defect due to vibration during the printing work. Specifically, when the cartridge is completely mounted to a main body frame, a pressing member employing a spring or the like downwardly presses the cartridge in order to prevent the cartridge from being moved by vibration according to driving of internal parts of the image forming apparatus.

However, the conventional image forming apparatus is configured to assemble various components such as the pressing member, the spring, etc., with respect to the main body frame. Since individual components are respectively manufactured and assembled, manufacturing cost and processes increase, and it is necessary to consider tolerance among components in designing the image forming apparatus. Also, if the number of components increases, the image forming apparatus becomes more likely to break down because the configuration thereof becomes more complicated.

SUMMARY

Accordingly, an aspect of the present general inventive concept is to provide an image forming apparatus having a simple structure capable of stably mounting and supporting an image forming cartridge mounted to a main body frame.

Embodiments of the present general inventive concept provide an image forming apparatus including a main body housing formed with an opening, a main body frame coupled to the main body housing, an image forming cartridge mounted to the main body frame via the opening, and a cartridge supporting member which includes a supporting member main body formed integrally with the main body frame, and a supporting part formed in the supporting main body to elastically support the image forming cartridge with respect to the main body frame, so that the image forming cartridge can be mounted to the main body frame as the supporting member main body elastically moves to a cutting part formed in a part of the main body frame adjacent to the supporting member main body when the supporting part is pressed by the image forming cartridge.

Embodiments of the present general inventive concept also provide that the supporting part may include a first supporting part pressing the image forming cartridge mounted to the main body frame; and a second supporting part curved from the first supporting part and guiding the image forming cartridge to the first supporting part so that the image forming cartridge moves to be mounted to the main body frame.

Embodiments of the present general inventive concept provide that the supporting member main body may elastically move in a direction to mount the image forming cartridge as the image forming cartridge presses the second supporting part.

Embodiments of the present general inventive concept also provide that the supporting part may protrude from the supporting member main body toward the mounted image forming cartridge.

Embodiments of the present general inventive concept also provide that the cutting part may be formed in a part adjacent to the cartridge supporting member along a moving direction of the image forming cartridge so that the cartridge main body can move elastically.

Embodiments of the present general inventive concept also provide that the image forming apparatus may further include a main body electrode terminal installed in the main body frame, wherein the image forming cartridge includes a cartridge electrode terminal electrically connected to the main body electrode terminal and provided to receive electric power or ground the image forming cartridge through the main body electrode terminal when the image forming cartridge is mounted to the main body frame.

Embodiments of the present general inventive concept also provide that the image forming apparatus may further include a guide rail formed on the main body frame along a moving path of the image forming cartridge and guiding the image forming cartridge to move with respect to the main body frame.

Embodiments of the present general inventive concept also provide that the image forming cartridge may include a cartridge housing, a rail projection formed in the cartridge housing and supported by the guide rail, and a supporting projection spaced apart from the rail projection and formed to contact the supporting part.

Embodiments of the present general inventive concept also provide that the guide rail may include a move-in restriction part restricting movement of the rail projection.

Embodiments of the present general inventive concept also provide that the supporting part may be curved and extends along the moving direction of the image forming cartridge, and the supporting projection may include a seating part to accommodate a curved part of the supporting part when the rail projection is placed in the move-in restriction part.

Embodiments of the present general inventive concept also provide that the image forming apparatus may further include a main body electrode terminal installed in the main body frame, wherein the image forming cartridge includes at least one cartridge electrode terminal electrically connected to the main body electrode terminal and provided in the cartridge housing to receive electric power or ground the image forming cartridge through the main body electrode terminal when the image forming cartridge is mounted to the main body frame.

Embodiments of the present general inventive concept also provide that the rail projection and the cartridge electrode terminal may be formed as a single body.

Embodiments of the present general inventive concept also provide that an image forming cartridge, comprising a cartridge housing comprising side walls to support a driven gear, a rail projection formed on one of the sidewalls and having a shape to facilitate travel along a guide rail, and a supporting projection formed on the one of the sidewalls spaced apart from the rail projection by a distance, and having a shape to facilitate travel along a cartridge supporting member.

Embodiments of the present general inventive concept also provide that an image forming apparatus, comprising a main body frame having a driving force transmitting gear, a guide rail, and a cartridge supporting member, and an image forming cartridge having a cartridge housing comprising sidewalls to support a driven gear, a rail projection formed on one of the sidewalls and having a shape to facilitate travel along the guide rail, and a supporting projection formed on the one of the sidewalls spaced apart from the rail projection by a distance, and having a shape to facilitate travel along the cartridge supporting member.

BRIEF DESCRIPTION OF THE DRAWINGS

These and/or other features and utilities of the present general inventive concept will become apparent and more readily appreciated from the following description of the exemplary embodiments, taken in conjunction with the accompanying drawings, in which.

DETAILED DESCRIPTION OF THE EMBODIMENTS

Figure 1:
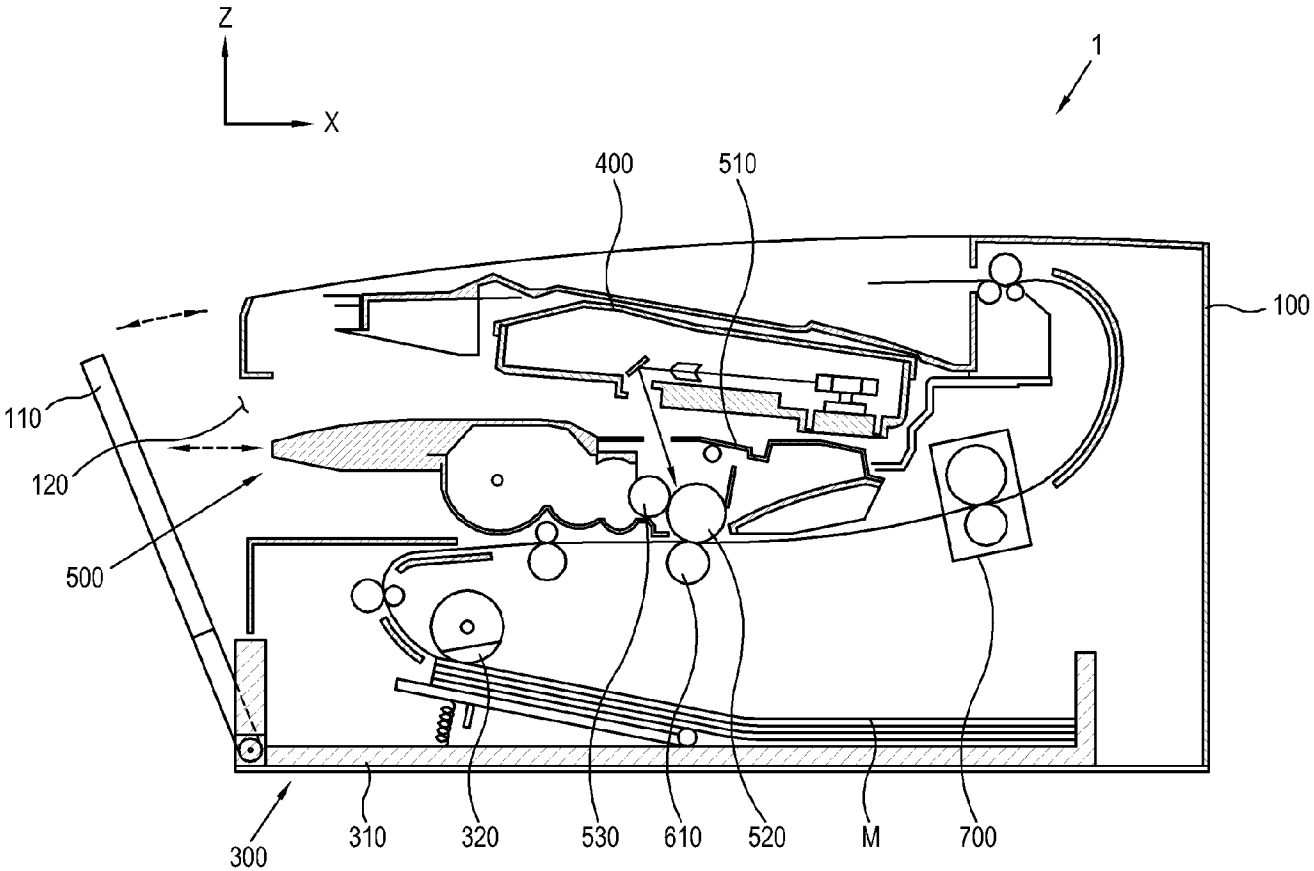
FIG. 1 is a side sectional view of an image forming apparatus according to an exemplary embodiment of the present general inventive concept.

Reference will now be made in detail to the exemplary embodiments of the present general inventive concept, examples of which are illustrated in the accompanying drawings, wherein like reference numerals refer to like elements throughout. The exemplary embodiments of the present general inventive concept are described below so as to explain the present general inventive concept by referring to the figures. Repetitive description with respect to like elements of different embodiments of the present general inventive concept may be omitted for the convenience of clarity.

FIG. 1 is a side sectional view of an image forming apparatus according to an exemplary embodiment of the present general inventive concept. The image forming apparatus 1 according to the exemplary embodiment of the present general inventive concept may be achieved by a mono image forming type where a mono color image is formed on a printing medium by a mono color developer.

As illustrated in FIG. 1, the image forming apparatus 1 according to an exemplary embodiment of the present general inventive concept includes a main body housing 100 forming an outer appearance, and a front cover 110 rotatably coupled to the main body housing 100 and covering or opening the front of the main body housing 100.

Also, the image forming apparatus 1 according to an exemplary embodiment of the present general inventive concept may further include a medium supplying unit 300 loading and supplying a printing medium M, an exposure unit 400 forming an electrostatic latent image on an image carrying body 520, an image forming cartridge 500 forming an image based on the latent image on the printing medium M, and a fusing unit 700 fixing an image on the printing medium M.

The main body housing 100 may accommodate elements of the image forming apparatus 1 therein, and may be formed with an opening 120 in the front thereof. The opening 120 is formed to allow a user to mount or detach the image forming cartridge 500 to or from the main body housing 100. The opening 120 may be opened or closed by the front cover 110.

The medium supplying unit 300 may include a loading cassette 310 where the printing medium M is loaded, and a pickup roller 320 picking up and supplying the printing medium M loaded in the loading cassette 310. When a printing operation is started, the pickup roller 320 may pick up the topmost printing medium M among the printing medium M loaded in the loading cassette 310 sheet by sheet and supply it to the image forming cartridge 500.

During a printing operation, the image forming cartridge 500 may form an image on the printing medium M picked up and supplied by the pickup roller 320. The image forming cartridge 500 in this exemplary embodiment of the present general inventive concept comprises a cartridge housing 510 in which a developer is stored, the image carrying body 520 installed in the cartridge housing 510, a developing roller 530, and other configurations (not shown) such as a charging roller, a cleaning blade, etc.

With this configuration, the exposure unit 400 may form a latent image on the image carrying body 520, and the developing roller 530 may supply the developer onto the latent image, thereby forming a visible image with the developer on the image carrying body 520. The image forming apparatus 1 may include a transfer roller 610 installed corresponding to the image carrying body 520. While the print medium M passes between the image carrying body 520 and the transfer roller 610 to which a transfer bias is applied, the visible image may be transferred from the image carrying body 520 to the printing medium M. Thus, an image may be formed on the printing medium M.

As the printing operation is repeated, the developer of the image forming cartridge 500 may be exhausted or the elements such as the image carrying body 520 or the like of the image forming cartridge 500 may be worn away. Accordingly, the image forming cartridge 500 may be replaceable. Thus, a user can open the front cover 110 and then mount or detach the image forming cartridge 500 through the opening 120.

During the printing operation, driving of the image forming apparatus 1 may cause vibration. Because of the vibration, there is needed a configuration to stably support the image forming cartridge 500 which is not fastened to the image forming apparatus 1. This configuration will be described with reference to FIG. 2.

Figure 2:
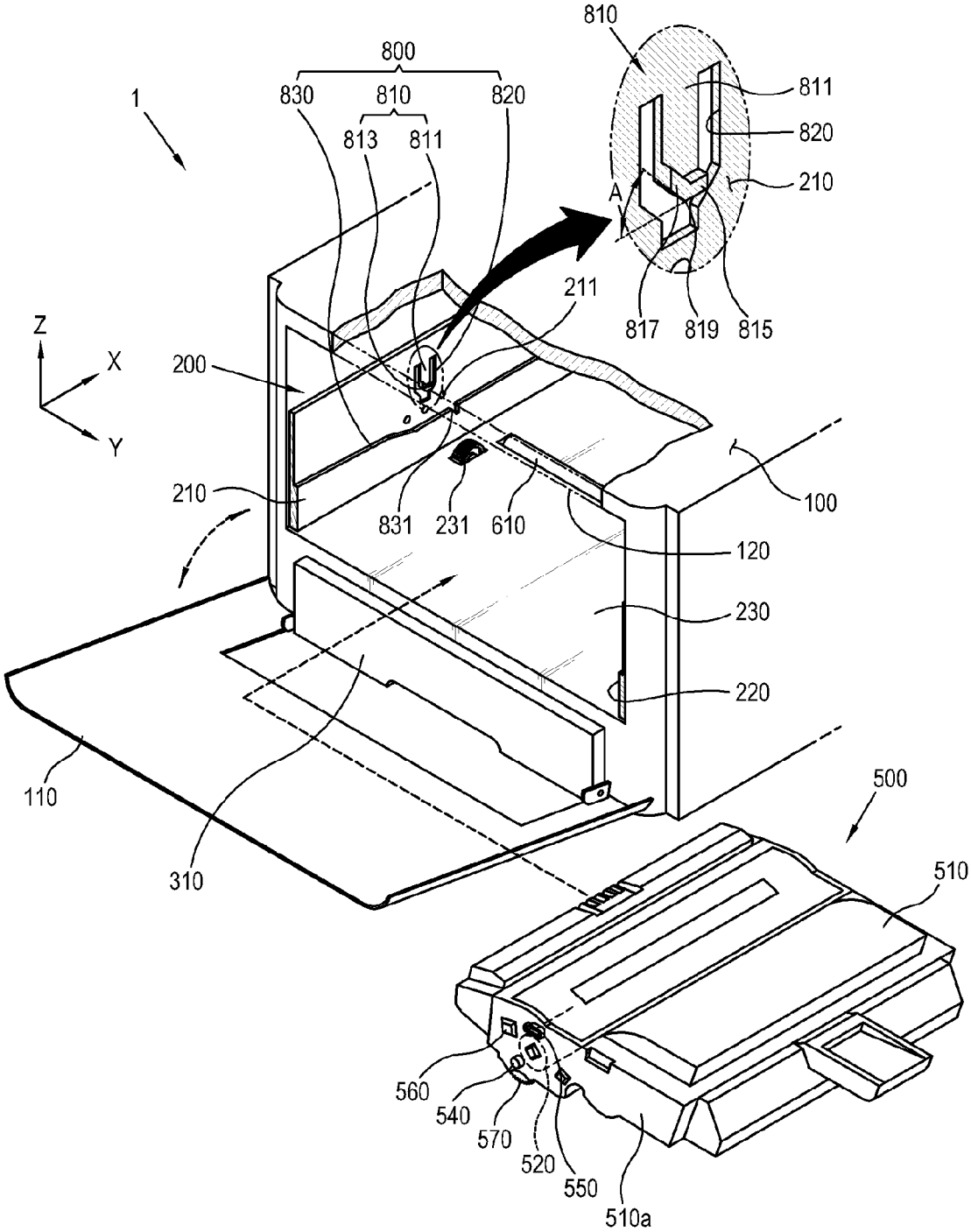
FIG. 2 is a main part perspective view illustrating an image forming cartridge and a main body frame of the image forming apparatus in FIG. 1.

FIG. 2 is a perspective view of a main part perspective view illustrating the image forming cartridge 500 and a cartridge supporting assembly 800 to support the image forming cartridge 500 in the image forming apparatus of FIG. 1.

As illustrated in FIG. 2, in the image forming apparatus 1 according to an exemplary embodiment of the present general inventive concept, the image forming cartridge 500 may be detachable with respect to the inside of the main body housing 100. A user may open the front cover 110, and mount or detach the image forming cartridge 500 to or from the inside of the main body housing 100 via the opening 120.

The image forming apparatus 1 may include a main body frame 200 coupled to the main body housing 100, and the cartridge supporting assembly 800 installed in the main body frame 200 so as to guide the image forming cartridge 500 to be mounted and detached and to support the image forming cartridge 500 mounted to the main body frame 200.

The main body frame 200 may be installed inside the main body housing 100 and may support the image forming cartridge 500 and other elements of the image forming apparatus 1. The main body frame 200 may be provided separately from the main body housing 100 and then coupled to the main body housing 100. Alternatively, the main body frame 200 and the main body housing 100 may be formed as a single body.

The main body frame 200 may include a left frame 210, a right frame 220, and a lower frame 230 which are extended along an X direction, i.e., a mounting direction of the image forming cartridge 500. The left frame 210, the right frame 220, and the lower frame 230 may be opened outward through the opening 120.

The lower frame 230 may partition the inside of the main body housing 100 into the medium supplying unit 300 and the image forming cartridge 500. Meanwhile, a driving force transmitting gear 231 and the transfer roller 610, operated by a driving force from a driving source (not shown), are arranged at one side of the lower frame 230.

The left frame 210 and the right frame 220 stand at opposite sides of the lower frame 230 and face with each other. Further, when the image forming cartridge 500 is mounted to the main body frame 200, the left frame 210 and the right frame 220 face both sides of the image forming cartridge 500, respectively. At least one of the left frame 210 and the right frame 220 may be provided with a main body electrode terminal 211.

The main body electrode terminal 211 may be electrically connected to the image forming cartridge 500 mounted to the main body frame 200, so that the image forming cartridge 500 can receive electric power or be grounded.

The image forming cartridge 500 may include a cartridge housing 510, a rail projection 540 formed in the cartridge housing 510, a supporting projection 550 formed in the cartridge housing 510 while being spaced apart from the rail projection 540, a cartridge electrode terminal 560 corresponding to the main body electrode terminal 211, and a driven gear 570 corresponding to the driving force transmitting gear 231. Further, the rail projection 540, supporting projection 550, cartridge electrode terminal 560, and driven gear 570 are located on a sidewall 510*a* of the cartridge housing 510.

The shape of the rail projection 540 may not be limited. However, it may be preferable but not necessary that the rail projection 540 has a cylindrical shape to allow the image forming cartridge 500 to smoothly move. Further, it may be preferable that the rail projection 540 be a roller to rotate about a center of a shaft formed on the cartridge housing 510.

The supporting projection 550 may be distanced from the rail projection 540, and may be pressed by the cartridge supporting member 810 when the image forming cartridge 500 is mounted to the main body frame 200. The supporting projection 550 can be an elastic element to be elastically deformed and generate an elastic force outside of the cartridge housing 510. Accordingly, the supporting projection 550 may be pressed by the cartridge supporting member 810 so that the image forming cartridge 500 can be stably supported.

The cartridge supporting assembly 800 may include a cartridge supporting member 810 elastically pressing and supporting the image forming cartridge 500 mounted to the main body frame 200, a cutting part 820 formed by cutting a part of the main body frame 200 and adjacent to the cartridge supporting member 810, and a guide rail 830 formed in the main body frame 200 along a moving path of the image forming cartridge 500.

Below, the respective elements of the image forming cartridge 500 will be described in more detail.

Here, the rail projection 540 and the supporting projection 550 may be formed at both left and right sides or at only one side of the cartridge housing 510. In this exemplary embodiment of the present general inventive concept, the rail projection 540 and the supporting projection 550 are symmetrically formed at both sides of the cartridge housing 510 so that the image forming cartridge 500 can be more stably mounted. However, descriptions will be accomplished with regard to only one side, and repetitive descriptions about the other side will be avoided.

The rail projection 540 may be supported and guided by the guide rail 830 and may slide in an X direction when the image forming cartridge 500 is mounted to the main body frame 200. On the other hand, the rail projection 540 is guided by the guide rail 830 and may slide in a −X direction when the image forming cartridge 500 is detached from the main body frame 200. Thus, the rail projection 540 may enable the image forming cartridge 500 to stably move.

Further, the rail projection 540 is seated on the guide rail 830 and receives the weight of the image forming cartridge 500, so that the image forming cartridge 500 mounted to the main body frame 200 can be stably supported.

Meanwhile, the rail projection 540 is not limited to the foregoing shape as long as it can slide along the guide rail 830. For example, the rail projection 540 may have a cylindrical shape to allow the image forming cartridge 500 to slide easily, in which the curvature of the cylinder is in contact with the guide rail 830.

The supporting projection 550 is formed on the lateral side of the cartridge housing 510 formed with the rail projection 540 as being spaced apart from the rail projection 540. The supporting projection 550 may be elastically supported by the cartridge supporting member 810 when the image forming cartridge 500 is mounted to the main body frame 200.

In this exemplary embodiment of the present general inventive concept, the supporting projection 550 may be disposed above the rail projection 540. When the image forming cartridge 500 is mounted to the main body frame 200, the supporting projection 550 may be downwardly pressed by the cartridge supporting member 810. At this time, the rail projection 540 supported by the guide rail 830 may receive elastic pressure applied from the cartridge supporting member 810 to the supporting projection and the weight of the image forming cartridge 500. Thus, the image forming cartridge 500 can be supported more stably. However, this is just an exemplary embodiment of the present general inventive concept, and a position of the cartridge housing 510, where the supporting projection 550 is formed, is not restricted.

Figure 3:
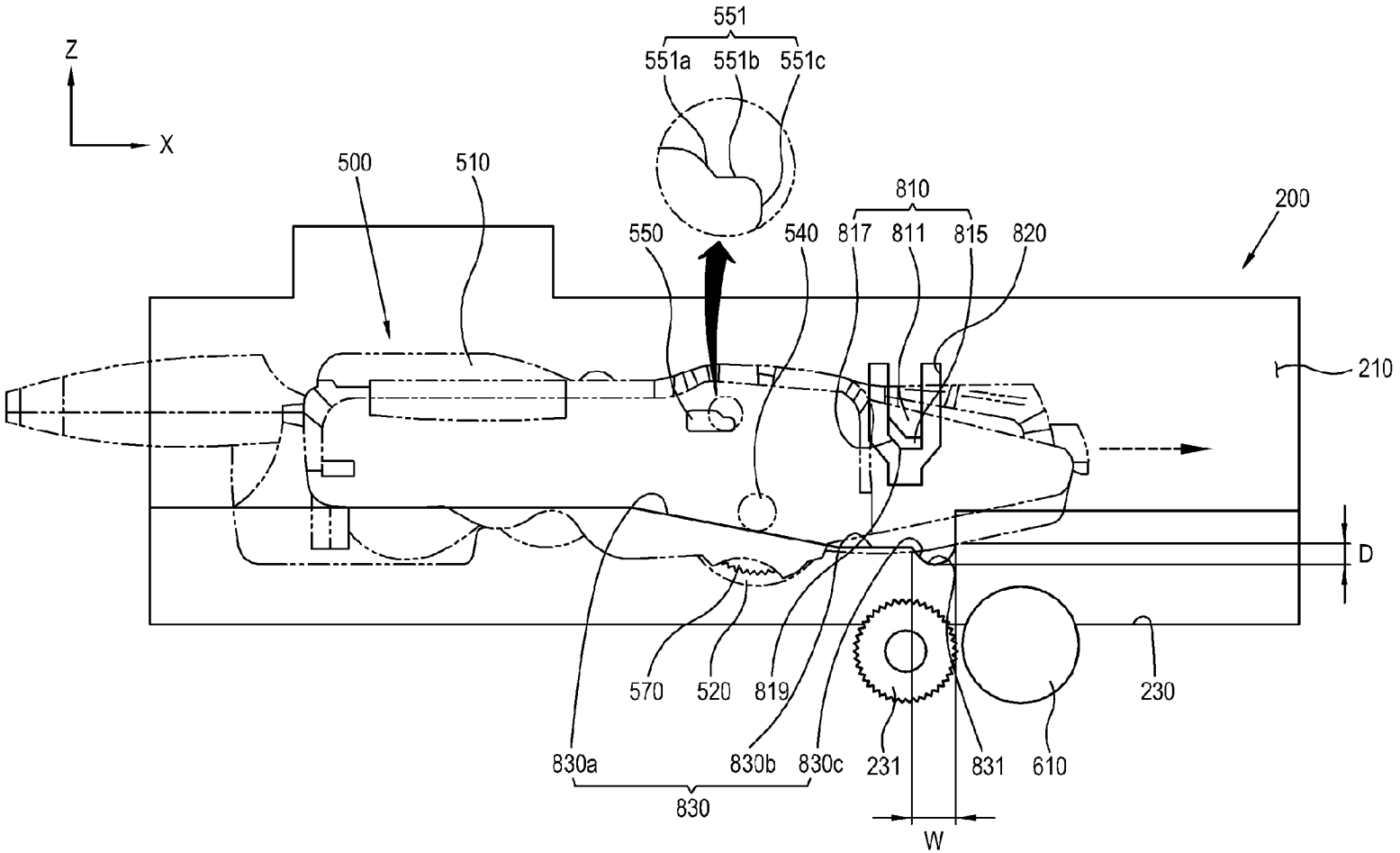
FIGS. 3 to 5 are side sectional views illustrating a process of mounting the image forming cartridge in FIG. 2 to the main body frame.
Figure 4:
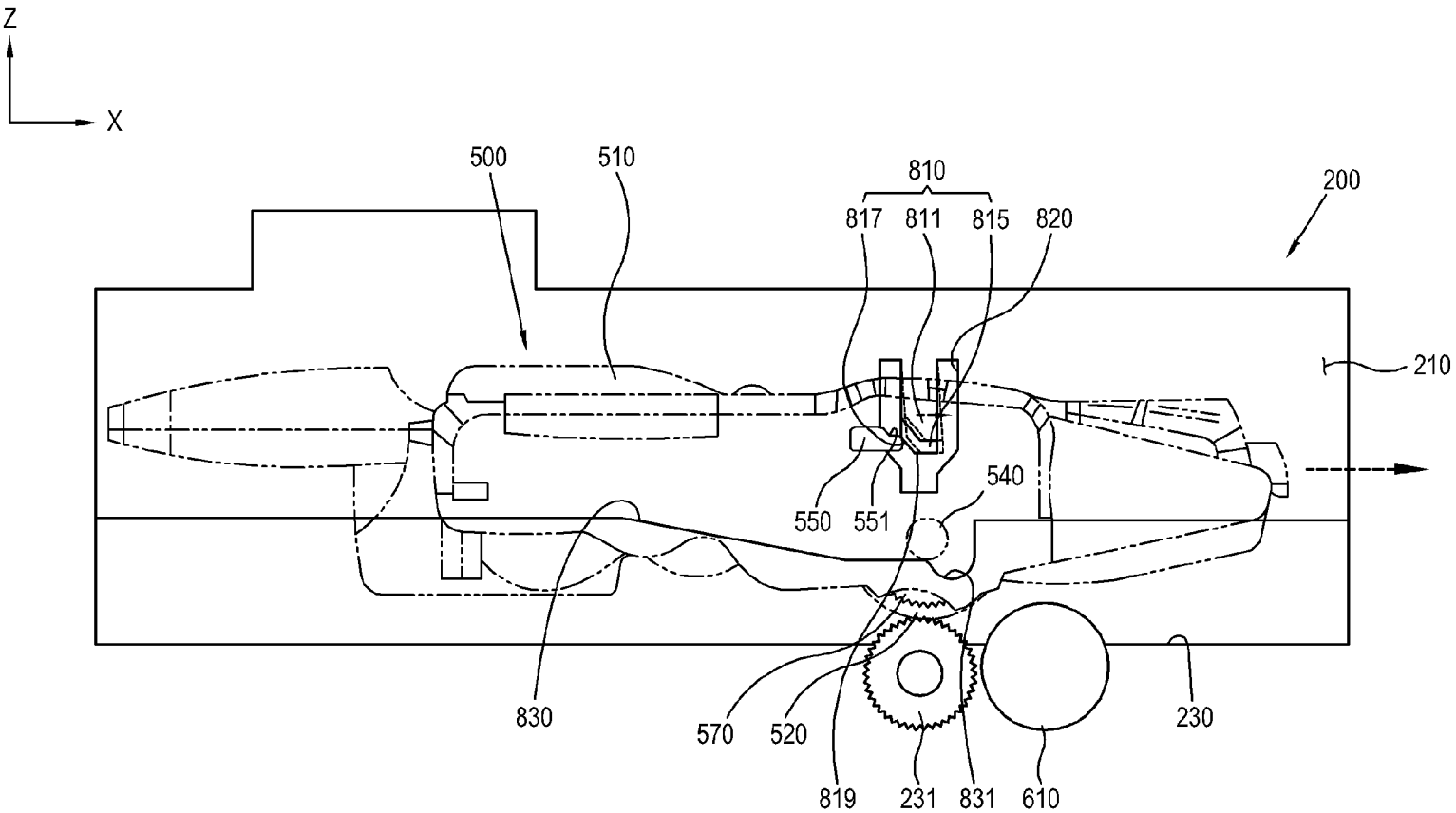
Figure 5:
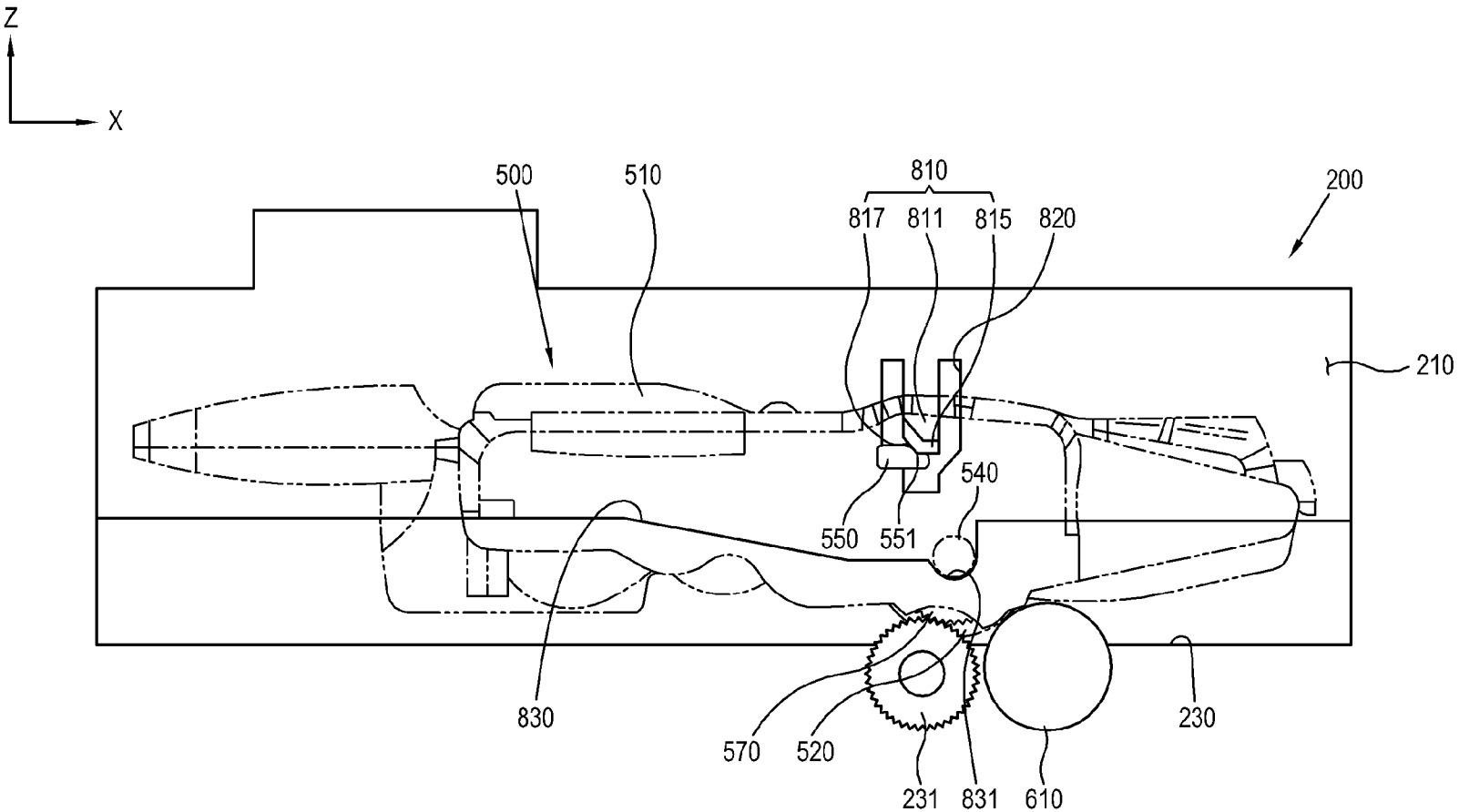

The supporting projection 550 may be formed with a seating part 551 recessed at a part to be in contact with the cartridge supporting member 810 (refer to FIGS. 3 to 5). The seating part 551 may accommodate and support a curved part 819 between a first supporting part 815 and a second supporting part 817 (to be describe later) when the seating part 551 is mounted to the main body frame 200, so that the supporting projection 550 can be stably pressed by the cartridge supporting member 810.

Also, the seating part 551 may be cut at a part to be in contact with the first supporting part 815 and the second supporting part 817 (to be described later) when the image forming cartridge 500 moves to be mounted to the main body frame 200, so that the supporting projection 550 can more readily move to a position where the supporting projection 550 is elastically pressed by the cartridge supporting member 810.

The cartridge electrode terminal 560 may be electrically connected to the main body electrode terminal 211 when the image forming cartridge 500 is mounted to the main body frame 200. Thus, power supply or ground for the image forming cartridge 500 can be achieved through the main body electrode terminal 211 and the cartridge electrode terminal 560.

In this exemplary embodiment of the present general inventive concept, the cartridge electrode terminal 560 may be separately provided, but is not limited thereto. Alternatively, the cartridge electrode terminal 560 may be formed integrally with the rail projection 540 or the supporting projection 550.

The driven gear 570 may be installed to be at least partially exposed to the outside of the cartridge housing 510, and interlocked with driving elements such as the image carrying body 520 of the image forming cartridge 500. The driven gear 570 may be exposed to a lower side of the cartridge housing 510, and disposed to be engaged with the driving force transmitting gear 231 when the image forming cartridge 500 is mounted to the main body frame 200.

While engaging with the driving force transmitting gear 231, the driven gear 570 may interlock with rotation of the driving force transmitting gear 231, thereby transmitting the driving force from the driving force transmitting gear 231 and thus rotating the image carrying body 520 or the like. Therefore, it is possible to drive the image forming cartridge 500 even through the image forming cartridge 500 itself does not include a separate driving source (not shown).

Below, the respective elements of the cartridge supporting assembly 800 will be described in more detail. In the following, the cartridge supporting assembly 800 installed in the left frame 210 will be representatively described, and repetitive descriptions about that installed in the right frame 220 will be avoided.

The cartridge supporting member 810 may downwardly press the image forming cartridge 500 mounted to the main body frame 200, thereby elastically supporting the image forming cartridge 500 not to move up and down. The cartridge supporting member 810 may be formed by partially cutting a plate of the left frame 210. Since the cartridge supporting member 810 and the left frame 210 are formed as a single body, the cartridge supporting member 810 can be easily manufactured without considering tolerance among plural components to be assembled.

The cartridge supporting member 810 may include a supporting member main body 811 formed integrally with the left frame 210 and extended downwardly, and a supporting part 813 protruding from an end part of the supporting member main body 811 in order to contact the supporting projection 550.

The supporting member main body 811 may elastically urge the supporting part 813 to support the supporting projection 550 when the image forming cartridge 500 is mounted to the main body frame 200. That is, because the stable support of the image forming cartridge 500 depends on the elasticity of the supporting member main body 811, the thickness, the width, etc., of the supporting member main body 811 can be variously designed in consideration of the elasticity thereof. In the meantime, since the cartridge supporting member 810 and the main body frame 200 are formed as a single body, the supporting member main body 811 may include the same material as the main body frame 200.

The supporting member main body 811 may elastically move in the X direction so that the supporting projection 550 can move to a position to be supported by the supporting part 813 if the supporting projection 550 presses the supporting part 813 as the image forming cartridge 500 slides in the X direction. To allow the supporting member main body 811 to elastically move, the cutting part 820 is adjacently formed in the X direction of the supporting member main body 811 and may provide a moving space for the supporting member main body 811. Thus, the supporting member main body 811 can elastically move in the X direction through the cutting part 820, and return to an original position as the supporting projection 550 moves to the position to be supported by the supporting part 813.

The supporting member main body 811 may extend downward perpendicular to an installation surface of the image forming apparatus 1, and the supporting part 813 may be formed at an extended end part of the supporting member main body 811, thereby pressing the image forming cartridge 500 downwardly.

The supporting part 813 may protrude from the end part of the supporting member main body 811 in a Y direction toward the right frame 220, i.e., in a direction toward the image forming cartridge 500. The supporting part 813 may protrude to contact the supporting projection 550, and may press the supporting projection 550 downwardly if the supporting projection 550 enters below the supporting part 813. The supporting part 813 will be described in more detail later.

The guide rail 830 is formed along a moving path for mounting the image forming cartridge 500 extended in the X direction on the left frame 210. The guide rail 830 is formed to guide the rail projection 540 to move, and may be shaped like a groove to accommodate the rail projection 540. In this exemplary embodiment of the present general inventive concept, the guide rail 830 is shaped like a platform where the rail projection 540 is seated.

Further, the guide rail 830 may extend straightly along the X direction. In this exemplary embodiment of the present general inventive concept, the guide rail 830 gently slopes downward, so that the image forming cartridge 500 can be easily mounted by its own weight.

Also, FIG. 3 illustrates three sections of the guide rail 830; first guide 830*a*, second guide 830*b*, and third guide 830*c*, wherein the first guide 830*a* may provide an inclined surface, the second guide 830*b* may provide a flat surface, and the third guide 830*c* may provide another inclined surface to contact the second supporting part 817 during an initial insertion process. Also, FIG. 3 further defines elements of the seating part 551. More specifically, seating part 551 includes a first seating part 551 a, second seating part 551*b*, and third seating part 551*c*, wherein the first seating part 551*a* may provide an inclined surface, the second seating part 551*b* may provide a flat surface, and the third seating part 551*c* may provide another inclined surface.

Further, as illustrated in FIG. 3, W and D represent dimensions of the move-in restriction part 831.

If a user pushes the image forming cartridge 500 through the opening 120 in the X direction, the rail projection 540 may be seated on the guide rail 830. Further, the guide rail 830 may include a move-in restriction part 831 which restricts the rail projection 540 seated at a preset position not to move any more in the X direction when the rail projection 540 moves while guided by the guide rail 830.

That the rail projection 540 is placed in the move-in restriction part 831 may indicate that the image forming cartridge 500 is mounted to the main body frame 200. Specifically, while the rail projection 540 is placed in the move-in restriction part 831, the image carrying body 520 may be positioned corresponding to the transfer roller 610, the driven gear 570 may be engaged with the driving force transmitting gear 231, and the supporting projection 550 may be pressed and supported by the supporting part 813.

Below, the cartridge supporting member 810 will be described in more detail.

When the image forming cartridge 500 moves in the X direction, the guide rail 830 correspondingly extends in the X direction. The supporting member main body 811 extends in a −Z direction, and the supporting part 813 may be formed on the supporting member main body 811.

Here, the supporting part 813 may include the first supporting part 815 extended in the X direction, and the second supporting part 817 curved from the first supporting part 815 at a predetermined angle toward the −X direction. Further, the curved part 819 may be formed between the first supporting part 815 and the second supporting part 817.

While the rail projection 540 is positioned at the move-in restriction part 831, the first supporting part 815 may contact and elastically support the supporting projection 550. In this exemplary embodiment of the present general inventive concept, the supporting member main body 811 extends perpendicular to the installation surface of the image forming apparatus 1, and the first supporting part 815 extends in parallel with the installation surface of the image forming apparatus 1. However, this is just an exemplary embodiment of the present general inventive concept, and an extension angle of the first supporting part 815 is not limited thereto.

The second supporting part 817 may be upwardly curved from the first supporting part 815 at a predetermined angle in a direction opposite to the direction to mount the image forming cartridge 500, i.e., in the −X direction where the image forming cartridge 500 is detached. Here, a curved angle A of the second supporting part 817 to the first supporting part 815 may be varied within a range of $0<A<90$ degrees.

If there is only the first supporting part 815 without the second supporting part 817, it may be difficult for the supporting projection 550 to enter the first supporting part 815 when the image forming apparatus 500 moves in the X direction, because the first supporting part 815 extends in the X direction. Therefore, the second supporting part 817 curved from the first supporting part 815 is needed to easily guide the supporting projection 550 toward the first supporting part 815.

In this exemplary embodiment of the present general inventive concept, the supporting part 813 includes one curved part 819, but not is limited thereto. Alternatively, the supporting part 813 may include a plurality of curved parts 819.

Embodiments of the present general inventive concept further include a process of mounting and supporting the image forming cartridge 500 to the main body frame 200 which will be described with reference to FIGS. 3 to 5. FIGS. 3 to 5 are side sectional views illustrating a process of mounting the image forming cartridge 500 to the main body frame 200, in which the left frame 210 and the cartridge supporting assembly 800 of FIG. 2 are seen in the −Y direction.

According to an exemplary embodiment of the present general inventive concept, a process of mounting the image forming cartridge 500 to the main body frame 200 will be described supposing that the image forming cartridge 500 is separated from the main body frame 200 in an initial state. Meanwhile, it will be appreciated that a process of detaching the image forming cartridge 500 from the main body frame 200 can be analogized out of the following mounting process, and thus descriptions thereof will be omitted.

Referring to FIG. 3, a user may push the image forming cartridge 500 to the main body frame 200 through the opening 120. As the image forming cartridge 500 moves in the X direction, the supporting projection 550 is guided by the guide rail 830 and slides in the X direction.

Thus, when the image forming cartridge 500 proceeds to move, one side of the supporting projection 550 may contact the supporting part 813, i.e., the second supporting part 817 as shown in FIG. 4.

If the image forming cartridge 500 moves under this condition, the second supporting part 817 may be pressed by the supporting projection 550 and this pressure urges a free end of the supporting member main body 811 to elastically move by a predetermined interval in the X direction. The space for the elastic move may be provided by the cutting part 820 adjacently formed in the X direction of the supporting member main body 811.

The supporting projection 550 may move along the extension direction of the second supporting part 817 while pressing the second supporting part 817, so that the supporting member main body 811 can elastically move in the X direction, thereby allowing the supporting projection 550 to move.

When the supporting projection 550 enters the first supporting part 815, the second supporting part 817 may be released from the pressure. Thus, as shown in FIG. 5, the supporting member main body 811 returns to an original position, and the curved part 819 between the first and second supporting parts 815 and 817 is accommodated in the seating part 551.

Further, the rail projection 540 may be placed in the move-in restriction part 831, and thus the image forming cartridge 500 is restricted not to move any more. In this state, the driven gear 570 may be engaged with the driving force transmitting gear 231, and the image carrying body 520 is completely mounted to the main body frame 200.

Since the curved part 819 is accommodated in the seating part 551, the cartridge supporting member 810 stably and elastically presses the supporting projection 550, thereby stably supporting the image forming cartridge 500. Further, the driving force transmitting gear 231 and the driven gear 570 are engaged with each other, so that the driving force can be transmitted from the driving force transmitting gear 231 to the image forming cartridge 500.

Thus, since the cartridge supporting member 810 integrated with the main body frame 200 is used, the image forming cartridge 500 can be stably supported by a simple structure with respect to the main body frame 200.

Embodiments of the present general inventive concept further provide that the supporting projection 550 may be formed with the seating part 551 thereon to accommodate the curved part 819, but is not limited thereto. Alternatively, the supporting projection 550 may not be formed with the seating part 551. In this case, the lateral side of the supporting projection 550 contacting the first supporting part 815 may be formed in parallel with the first supporting part 815, so that the supporting projection 550 can be stably supported by the cartridge supporting member 810.

Although a few exemplary embodiments of the present general inventive concept have been illustrated and described, it will be appreciated by those skilled in the art that changes may be made in these exemplary embodiments of the present general inventive concept without departing from the principles and spirit of the invention, the scope of which is defined in the appended claims and their equivalents.

What is claimed is:

1. An image forming apparatus, comprising:

a main body housing formed with an opening;

a main body frame coupled to the main body housing;

an image forming cartridge mounted to the main body frame via the opening; and a cartridge supporting member which comprises:

a supporting member main body formed integrally with the main body frame, and a supporting part formed in the supporting member main body to elastically support the image forming cartridge with respect to the main body frame, so that the image forming cartridge can be mounted to the main body frame as the supporting member main body elastically moves to a cutting part formed in a part of the main body frame adjacent to the supporting member main body when the supporting part is pressed by the image forming cartridge.

2. The image forming apparatus according to claim 1, wherein the supporting part comprises:

a first supporting part pressing the image forming cartridge mounted to the main body frame; and a second supporting part curved from the first supporting part and guiding the image forming cartridge to the first supporting part so that the image forming cartridge moves to be mounted to the main body frame.

3. The image forming apparatus according to claim 2, wherein the supporting member main body elastically moves in a direction to mount the image forming cartridge as the image forming cartridge presses the second supporting part.

4. The image forming apparatus according to claim 2, wherein the supporting part protrudes from the supporting member main body toward the mounted image forming cartridge.

5. The image forming apparatus according to claim 1, wherein the cutting part is formed in a part adjacent to the cartridge supporting member along a moving direction of the image forming cartridge so that the cartridge main body can move elastically.

6. The image forming apparatus according to claim 1, further comprising:

a main body electrode terminal installed in the main body frame, wherein the image forming cartridge comprises:

a cartridge electrode terminal electrically connected to the main body electrode terminal and provided to receive electric power or ground the image forming cartridge through the main body electrode terminal when the image forming cartridge is mounted to the main body frame.

7. The image forming apparatus according to claim 1, further comprising:

a guide rail formed on the main body frame along a moving path of the image forming cartridge and guiding the image forming cartridge to move with respect to the main body frame.

8. The image forming apparatus according to claim 7, wherein the image forming cartridge comprises:

a cartridge housing;

a rail projection formed in the cartridge housing and supported by the guide rail; and a supporting projection spaced apart from the rail projection and formed to contact the supporting part.

9. The image forming apparatus according to claim 8, wherein the guide rail comprises:

a move-in restriction part restricting movement of the rail projection.

10. The image forming apparatus according to claim 9, wherein the supporting part is curved and extends along the moving direction of the image forming cartridge, and the supporting projection comprises:

a seating part to accommodate a curved part of the supporting part when the rail projection is placed in the move-in restriction part.

11. The image forming apparatus according to claim 8, further comprising:

a main body electrode terminal installed in the main body frame, wherein the image forming cartridge comprises at least one cartridge electrode terminal electrically connected to the main body electrode terminal and provided in the cartridge housing to receive electric power or ground the image forming cartridge through the main body electrode terminal when the image forming cartridge is mounted to the main body frame.

12. The image forming apparatus according to claim 11, wherein the rail projection and the cartridge electrode terminal are formed as a single body.

13. An image forming cartridge, comprising:

a cartridge housing comprising side walls to support a driven gear;

a rail projection formed on one of the sidewalls and having a shape to facilitate travel along a guide rail; and a supporting projection formed on the one of the sidewalls spaced apart from the rail projection by a distance, and having a shape to facilitate travel along a cartridge supporting member, the supporting projection comprising a plurality of recess sections to accommodate corresponding portions of the cartridge supporting member.

14. The image forming cartridge according to claim 13, wherein the rail projection is disposed closer to the driven gear than the supporting projection.

15. The image forming cartridge according to claim 13, wherein when the rail projection and the supporting projection are disposed at end positions of the guide rail, the driven gear is in contact with a driving force transmitting gear.

16. The image forming cartridge according to claim 13, wherein the rail projection comprises a shape of a cylinder.

17. The image forming cartridge according to claim 13, wherein at least one of the rail projection and the supporting projection is flexible with respect to the cartridge housing.

18. The image forming cartridge according to claim 13, wherein at least one of the rail projection and the supporting projection is flexible with respect to each other.

19. The image forming cartridge according to claim 13, wherein at least one of the rail projection and the supporting projection is flexible with respect to the cartridge support member.

20. An image forming apparatus, comprising:

a main body frame having a driving force transmitting gear, a guide rail, and a cartridge supporting member; and an image forming cartridge having a cartridge housing comprising sidewalls to support a driven gear;

a rail projection formed on one of the sidewalls and having a shape to facilitate travel along the guide rail; and a supporting projection formed on the one of the sidewalls spaced apart from the rail projection by a distance, and having a shape to facilitate travel along the cartridge supporting member, the supporting projection comprising a plurality of recess sections to accommodate corresponding portions of the cartridge supporting member.

21. The image forming apparatus according to claim 20, wherein the guide rail extends from the main body frame.

22. The image forming apparatus according to claim 20, wherein the cartridge supporting member comprises a supporting member main body extending from the main body frame, and a first supporting part and a second supporting part formed on the supporting member main body.

* * * * *